United States Patent [19]

Selfridge

[11] 4,043,038

[45] Aug. 23, 1977

[54] SYMMETRICAL WALLPAPER TRIMMER

[75] Inventor: Leroy K. Selfridge, Vista, Calif.

[73] Assignee: Eugene W. Selfridge, Portland, Oreg.

[21] Appl. No.: 756,287

[22] Filed: Jan. 3, 1977

Related U.S. Application Data

[63] Continuation-in-part of Ser. No. 704,500, July 12, 1976.

[51] Int. Cl.[2] ..... B26B 29/00

[52] U.S. Cl. ..... 30/293; 30/294

[58] Field of Search ..... 30/293, 294, 290, 289, 30/286

[56] References Cited

U.S. PATENT DOCUMENTS

| | | | |
|---|---|---|---|
| 1,574,641 | 2/1926 | Christopherson | 30/293 |
| 1,863,153 | 6/1932 | Christopherson | 30/293 |
| 2,109,686 | 3/1938 | Breidenbach | 30/286 |
| 2,676,405 | 4/1954 | Schierghofer | 30/293 |
| 2,677,180 | 5/1954 | Schierghofer | 30/293 X |
| 2,853,778 | 9/1958 | Pratt et al. | 30/294 |
| 3,009,246 | 11/1961 | Witherby | 30/286 X |
| 3,349,486 | 10/1967 | Voight | 30/294 |
| 3,500,540 | 3/1970 | Lundquist | 30/294 |
| 3,504,435 | 4/1970 | Sloboda et al. | 30/293 |

*Primary Examiner*—Al Lawrence Smith
*Assistant Examiner*—J. T. Zatarga
*Attorney, Agent, or Firm*—Chernoff & Vilhauer

[57] ABSTRACT

A hand-held wallpaper trimming tool symmetrically adapted for either left-handed or right-handed use which facilitates accurate and precise cutting of wallpaper along a joint between a wall being papered and an adjacent structural member. A guide portion is provided with a body member having a conically-shaped portion for resting against the adjacent structural member and gradually feeding the wallpaper into the joint, and with a pair of flat flanges for left-handed or right-handed use of the trimmer, alternatively, each attached at one edge thereof tangentially to the conical portion of the body member for placement against a wall being papered and pressing the paper smoothly against that wall. A selectably extensible cutting blade disposed at the apex end of the body member is mounted in a blade holder and secured by a releasable fastener. The blade holder may be rotated for orientation of the blade at a plurality of angles to the flanges with its cutting edge facing toward one or both of the flanges. An elongate handle projecting away from the base end of the body member is mounted on the blade holder for manipulating the trimming device and rotating the orientation of the blade. The handle, blade holder and blade may also be removed as a separate unit from the guide and utilized independently as a cutting tool.

9 Claims, 4 Drawing Figures

SYMMETRICAL WALLPAPER TRIMMER

CROSS-REFERENCE TO OTHER APPLICATION

This application is a continuation-in-part of my co-pending application, Ser. No. 704,500, filed July 12, 1976.

BACKGROUND OF THE INVENTION

This invention relates to hand-held tools for trimming the edges of wallpaper during attachment of the wallpaper to a wall.

In the hanging of wallpaper, that is, attaching strips of wallpaper to a wall, it is usually desirable to terminate the wallpaper strips precisely where the wall to which the strips are attached joins an adjacent structural member such as another wall, ceiling molding, floor baseboard or the like, so that there is no gap showing on the papered wall between the ends of the wallpaper strips and the aforementioned joint, or overlap of wallpaper onto the adjacent structural member, which would otherwise produce a disorderly and sloppy appearance. Ordinarily, this is accomplished by cutting the wallpaper strips to a length slightly greater than the distance they are to cover, pasting the strips to the wall and trimming their ends along a line produced by the joint between the papered wall and the adjacent structural member. Wallpaper is hung this way because the respective borders along which two opposing ends of a strip of wallpaper are to terminate typically are not spaced apart a consistent distance or precisely parallel to one another, and it is easy to make a slight, but significant, error in the length of the paper when measuring over a relatively great distance, such as about eight feet. Also, in many cases it is necessary to match the pattern on one strip of wallpaper with the pattern on an adjacent strip, and applying a strip of wallpaper which is slightly longer than necessary permits adjusting its position as it is attached thereby facilitating the proper matching of the patterns.

The aforedescribed trimming aspect of hanging wallpaper is a particularly difficult, laborious and time consuming task which sometimes results in unsightly errors and increases the cost of having wallpaper hung professionally. Consequently, numerous tools have been designed in an attempt to alleviate the difficulties encountered in trimming wallpaper edges. For example, Stanley U.S. Pat. No. 2,473,551 discloses a wallpaper trimmer having an elongate handle with a razor blade holder attached to one end. However, the Stanley trimmer provides no means for ensuring that the wallpaper is cut at precisely the right point. Scholl U.S. Pat. No. 3,724,010 also shows a hand-held wallpaper-trimming tool having a blade holder, a smoothing blade for guiding the wallpaper into place and a pair of guides disposed along respective edges of the smoothing blade to ensure that the cutting edge of the blade attacks the wallpaper at an angle to the wall on which it is placed, thereby preventing the production of a gap along the papered wall or overlap on the adjacent structural member due to the thickness of the cutting blade. While this design would seem to provide some advantages in trimming wallpaper, its shape would render cumbersome the positioning of the tool against a structural member adjacent the wall being papered and, due to the width of the guides relative to the length of the tool handle, substantial leverage is produced which could cause tipping of the tool during use, resulting in inaccurate cutting.

Another relevant wallpaper trimmer, disclosed in Voight U.S. Pat. No. 3,349,486, utilizes a pair of guide plates joined together at right angles to fit into the corner of a pair of perpendicular walls and a cutting blade which protrudes through the joint of the two guides to cut at a 45° angle from both walls. Although this device would facilitate trimming wallpaper at the joint between two perpendicular walls, it would be considerably less useful where the adjoining wall is not perpendicular or the wallpaper is to be trimmed along an adjacent structural member having a nonlinearly shaped edge, for example, rounded molding. In addition, no means is provided for gradually guiding the wallpaper from a wide curve into a sharp corner at the joint where it is to be trimmed. Ring U.S. Pat. No. 799,675 also shows a wallpaper cutting tool having a guide for positioning a cutting blade relative to a flat surface but, due to the obtuse angle between the blade and the guide, and to blade fastening hardware which protrudes outwardly from the plane of the blade, the tool would not be suitable for trimming wallpaper at many types of joints between a wall and an adjacent structural member, particularly where a perpendicular corner exists.

In the aforementioned co-pending patent application Ser. No. 704,500 a wallpaper trimmer device has been described and claimed which positions a cutting blade precisely at the joint between the wall being papered and the adjacent structural member, and at an angle to the surface of the wall being papered. The tool is also adapted to cut accurately and precisely at a variety of joints such as perpendicular walls, rounded molding adjoining a wall, or baseboard adjoining a wall, and to smoothly guide the wallpaper gradually into the cutting joint to minimize any damage due to tearing or creasing. Although the device described in that application greatly facilitates the trimming of wallpaper as it is hung, and can be used for either right-handed or left-handed operation, it is designed to accommodate one hand better than the other. Also, while the angle of attack of the cutting blade (that is, the angle of the blade to the wall) may be precisely fixed at its optimum position for most circumstances, no adjustability thereof is provided for. Accordingly, there is a need for an improved trimming device which accommodates either right-handed or left-handed operation equally well and provides for adjustment of the angle of attack of the blade.

SUMMARY OF THE INVENTION

The present invention reduces the aforementioned difficulties in trimming the ends of wallpaper as it is applied to a wall, overcomes the drawbacks of prior art trimming devices and improves upon the trimming device described in my previous application by providing a symmetrical hand-held cutting tool having a geometry which ensures the proper positioning of its wallpaper trimming blade, is particularly adapted to fit into a variety of joints, serves to draw wallpaper gradually into position in a joint for cutting and permits the tool to be used equally well with either the left or right hand. Moreover, it permits the angle of attack of the cutting blade with respect to the wall being papered to be adjusted.

The principal part of the trimming tool of the present invention comprises a guide portion having a body member including a portion having a conically-shaped surface and a pair of flat flanges each attached along one edge thereof to the body member tangential to its conical surface such that the flanges project away from the edges where they are attached and their planes converge toward an imaginary line disposed opposite the directions of projection thereof. The apex end of the conical body member, at which a cutting blade is disposed, is designed to be drawn accurately along a joint line at which the wallpaper is to be cut, the base of the conically-shaped portion facing in the direction of movement of the tool with the result that the uncut wallpaper is drawn gradually and smoothly, that is, "focused", from a wide curve into the more sharply curved joint where it is to be cut. Accurate positioning of the cutting blade is ensured due to the action of the flanges, one of which rests against the wall being papered, depending upon whether the tool is being grasped by the right hand or the left hand, and the conical surface of the body, which rests against the adjacent structural member, even where the adjoining structure is not perpendicular to the wall being papered or has a nonlinearly shaped edge such as molding, baseboard or the like. Also, the flange placed against the wall serves to press the wallpaper smoothly thereagainst as the paper is being cut.

A blade holder is removably and rotatably attached to the guide member, and accepts a replaceable blade which is positioned thereby adjacent the apex of the body member. By rotating the blade holder the angle of attack of the blade to the wall being papered may be adjusted regardless of which flange is placed against the wall so that the cutting direction of the blade is directed precisely along the desired line adjacent the joint of the outer surfaces of the wall and the adjacent structural member, thereby permitting optimum adjustment of the appearance of the cut. Once this angle is adjusted, it is maintained by the flange which rests against the wall being papered. The holder also permits the distance which the blade projects outwardly to be adjustable.

In addition, the tool is provided with an elongate handle attached to the base end of the guide such that it projects in a direction away from the apex end of the body member and opposite the line of convergence of the flange planes, and is disposed directly in the middle between the planes of the two flanges. This permits the tool to be held comfortably and to be properly positioned with one hand. In conjunction with the handle, a pair of finger rests are disposed at the apex end of the body member on both sides thereof for applying pressure on the forward end of the tool for stable positioning thereof and more effective cutting of the wallpaper. Also, the handle is attached to the blade holder, and the handle and blade holder are in turn attached to the guide such that they may be removed as a unit and utilized separately like a knife.

Therefore it is a principal objective of the present invention to provide a new and improved wallpaper trimming device which facilitates accurate and precise cutting of wallpaper.

It is another principal objective of the present invention to provide such a wallpaper trimming device which may be used equally well with the left hand or the right hand.

It is a further objective of the present invention to provide such a wallpaper trimming device which enables the angle of attack of the cutting member relative to a wall being papered to be adjusted, and which permits the cutting member and handle to be removed and used independently as a separate knife.

The foregoing objectives, features and advantages of the present invention will be more readily understood upon consideration of the following detailed description of the invention taken in conjunction with the accompanying drawings.

DETAILED DESCRIPTION OF THE INVENTION

Figure 1:
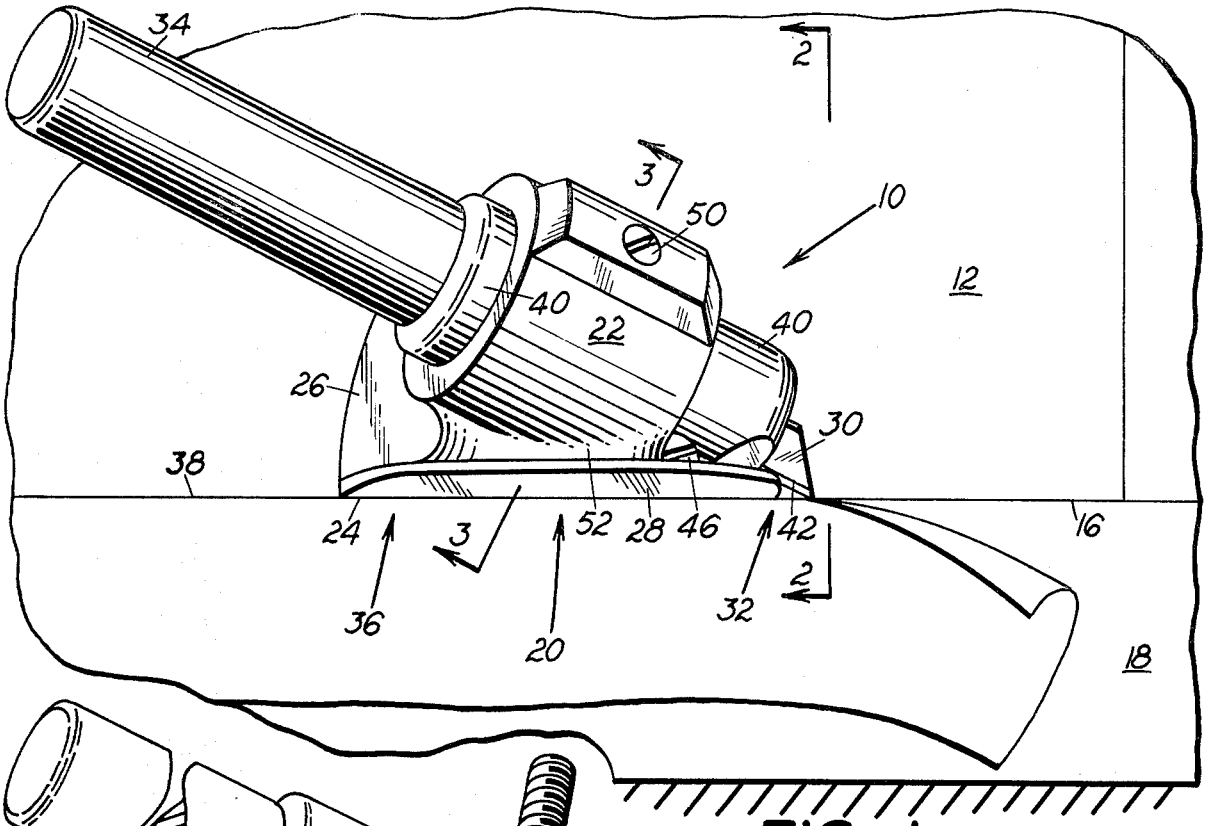
FIG. 1 is a side elevation of the wallpaper trimming device of the present invention showing a portion of wallpaper being trimmed.
Figure 2:
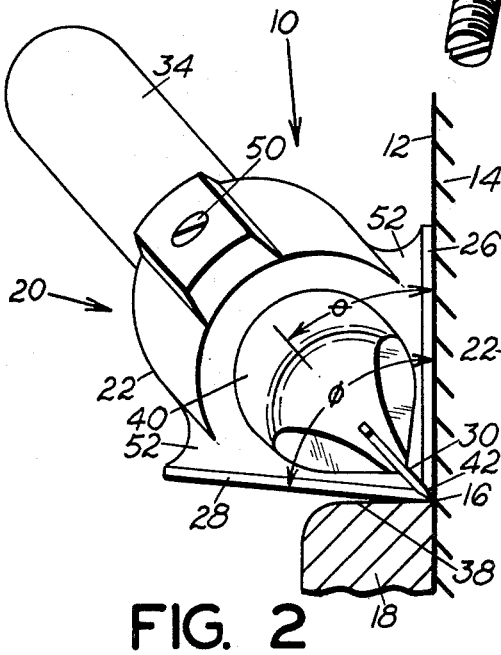
FIG. 2 is an end view of the wallpaper trimmer taken along line 2—2 of FIG. 1.
Figure 3:
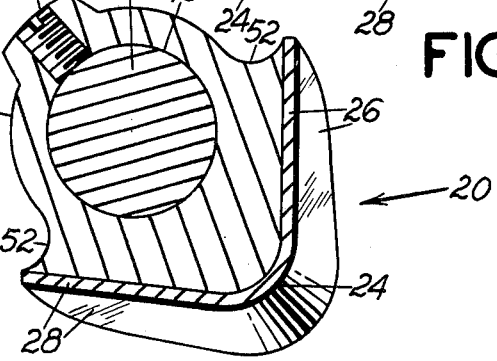
FIG. 3 is a section view of the wallpaper trimmer taken along line 3—3 of FIG. 1.

Referring to FIGS. 1-3, the wallpaper trimming tool 10 of the present invention is shown in use cutting the edge of a strip of wallpaper 12 being applied to a wall 14 along the outer surface joint 16 between the wall and a baseboard 18. The tool 10, comprises a guide portion 20 having a body member 22, an outer surface portion 24 (FIG. 3) in the shape of the lateral surface of a cone for positioning the tool and guiding the wallpaper into the joint, and two flat flanges 26 and 28 attached along respective edges thereof tangentially to the conically-shaped portion 24 of the body member and projecting away therefrom, also for positioning the tool and for pressing the wallpaper against a wall as it is cut, thereby forming a smooth continuous surface from the outermost edge of one flange to the outermost edge of the other. A cutting blade 30 is disposed adjacent the apex end 32 of the body member for cutting the wallpaper and an elongate handle 34 is attached to the body member protruding away from the base end 36 of the body member for manipulating the tool.

The tool is designed to accommodate either right-handed or left-handed use equally well, thus proper positioning of the tool, and hence the cutting blade 30, in a joint between the wall to be papered and an adjacent structural member is accomplished by placing one of the flanges 26 or 28 against the wall, with the wallpaper sandwiched between the selected flange and the wall and by resting the conically-shaped portion 24 of the body member against the adjacent structural member, such as the baseboard 18 having a linear edge 38 as shown in FIGS. 1 and 2.

For left-handed use of the trimmer the flange 26 would be placed against the wallpaper as shown in FIGS. 1 and 2, but for right-handed use the flange 28 would be placed against the wallpaper with the handle 34 projecting generally in the opposite direction. In either case the flange placed against the wallpaper and the conical side of the body member placed against an adjacent structural member provide unidirectional position references in two dimensions so that, by forcing the tool against these references, the position of the cutting blade will be stabilized, resulting in accurate cutting. Likewise, the tool may be used in an identical manner at the joint between a wall to be papered and another wall. The same applies as well where the adjacent structural member does not provide a linear edge 38 perpendicular to the wall 14 to be papered as is shown in the drawings, but where a rounded molding is utilized, or where two walls are joined at other than a 90° angle. In such cases the conical surface 24 of the body member may be moved one way or the other in the dimension of the plane of the wall until it comes to rest against the adjacent structure, and the blade 30 is moved inwardly or outwardly so that it strikes the wallpaper precisely at the joint 16 under that condition.

The tool is utilized by pulling the apex end 32 of the body along the joint 16 at which the wallpaper is to be cut, in the direction of the base end 36 of the tool. This causes the uncut portion of wallpaper preceding the base end of the tool and having a widely-curved bend therein to be drawn gradually and smoothly, that is, to be focused, into a relatively sharply-curved joint for cutting, without producing any tearing or creasing of the wallpaper. At the same time, since the particular flange being utilized, for example flange 26 for left-handed use as illustrated in the drawings, is being pressed against the wall, the apex end of the body member is also very close to the wall, while the portion of the base end closest to the joint is a distance away from the wall. Thus, the wallpaper is moved from a position a distance away from the wall, adjacent the base end of the body, to a position in contact with the wall, adjacent the apex end of the body, and is pressed firmly against the wall by the flange.

To ensure equally comfortable and effective use of the trimmer in either right-handed or left-handed operation the flanges 26 and 28 are placed symmetrically on opposite sides of the body member such that their planes converge toward an imaginary line disposed opposite the directions of projection of the flanges away from said body member. The angle $\phi$ between the flanges 26 and 28 should, preferably, be no more than 90° so that the trimmer will accommodate an angle between the wall and adjacent structural member of 90°. In fact, the angle $\phi$ may be somewhat less than 90° to accommodate slightly acute joint angles without having any detrimental affect on the performance of the trimmer.

Figure 4:
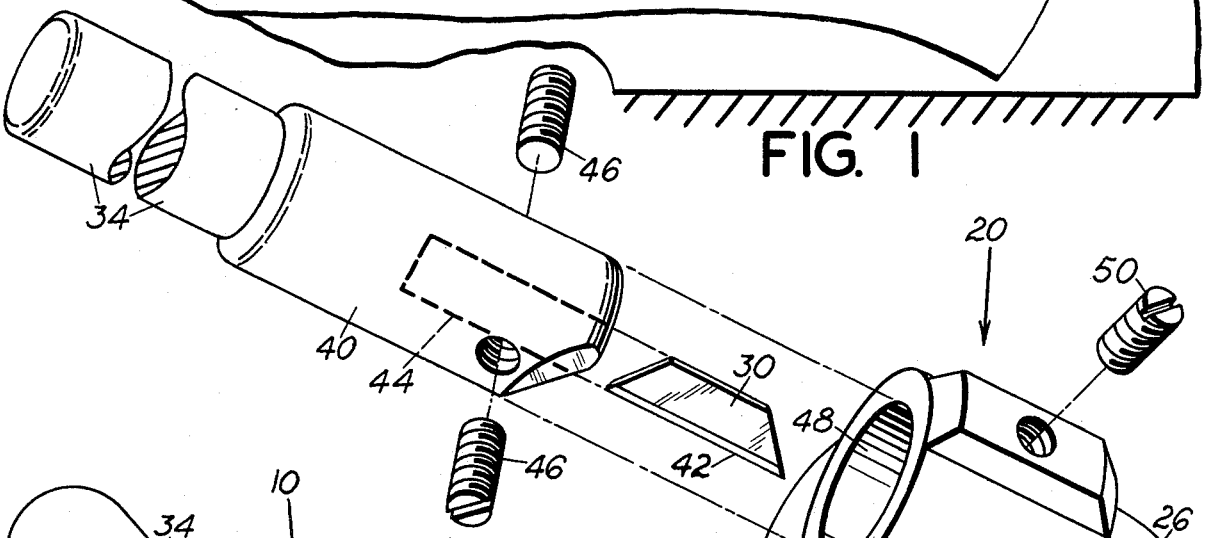
FIG. 4 is an exploded view of the wallpaper trimmer.

Referring particularly to FIG. 4, the blade 30 is mounted in a blade holder 40 attached to the body member 22 such that the blade may be positioned adjacent the apex end 32 of the trimmer. Preferably the trimmer should utilize an elongate replaceable metal blade, having a cutting edge 42 along one side, which may be replaceably mounted in an elongate receptacle 44 in the blade holder 40 so that the blade may move inwardly and outwardly relative to the blade holder for varying degrees of projection to compensate for different positioning of the body member and to provide for a variety of cutting depths. The blade may be secured by any appropriate fastening means, such as one or two set screws 46 which tighten against the sides of the blade to hold it in place.

Although the blade holder 40 may be attached to the body member 22 by any reasonable structure, it is particularly advantageous to utilize a cylindrically shaped blade holder which fits into a cylindrically shaped aperture 48 in the body member 22, whose axis is directed toward the apex end of the trimmer, and releasably secured in place by some appropriate means such as a set screw 50. It is particularly important that the blade 30 be mounted at an angle $\theta$ to the plane of the flange placed against the wall (flange 26 in the example) so that the sharp cutting edge 42 of the blade faces in a cutting direction running from the body member side of the flange angled toward the plane of the flange, thereby attacking the wallpaper more nearly at the precise point of meeting between the outside surfaces of the wall and the adjacent structural member then could be accomplished if the blade attacked either parallel to the wallpaper, which would cause a slight overlap of wallpaper onto the adjacent structure, or perpendicular to the wall, which would cause a slight gap between the edge of the wallpaper and the adjacent structure, due to the thickness of the blade. However, the proper positioning of the blade to achieve the optimum angle of attack to cut the wallpaper leaving the best appearance will depend upon which flange is placed against the wall and, under some circumstances, the optimum angle of attack will vary depending upon the nature of the joint. Accordingly, the set screw 50 may be loosened to enable the blade holder 40 to be rotated one way or the other within the aperture 48 to adjust the cutting direction of the blade 30.

The handle 34 of the cutting tool is attached to the blade holder 40 to extend away from the guide portion in a direction away from the apex end and the line of convergence of the flanges. Thus, the handle should be positioned between the planes of the two flanges and substantially centered on the plane of the blade 26. While the handle might alternatively be rigidly attached directly to the body member itself, the foregoing arrangement provides a means for rotating the blade holder within the aperture 48, while producing the required symmetry of the tool and permitting force to be applied to the tool along the axis of the blade to ensure maximum cutting effectiveness.

The combination of handle and blade holder can be removed from the body member 22 by loosening the set screw 50 which enables the blade holder and handle combination to be utilized as a separate cutting tool without the guide portion of the trimmer.

In conjunction with the handle, a pair of finger rests 52, preferably formed by the surface of the body member 22 between the body member and the flanges 26 and 28, are provided on opposite sides of the body member adjacent the apex end of the guide so that an individual using the tool may apply force to the apex end of the tool utilizing, ordinarily, his index finger. Such force applied by the user's finger increases the position stability of the tool and its cutting effectiveness as well.

The trimming tool 10 may be made of metal, plastic, or any convenient combination of those, or other, materials as long as it has sufficient strength to withstand the force necessary for cutting. If a moldable material is used, many of the parts can be integrated into single molded pieces. For example, the body member 22 and the flanges 26 and 28 could comprise one part, and the handle 34 and the blade holder 40 would comprise another separate part.

The terms and expressions which have been employed in the foregoing abstract and specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A wallpaper trimming device for cutting wallpaper at a joint between a wall being papered and an adjacent structural member, said trimming device comprising:

a. a body member for positioning said trimming device against said adjacent structural member and guiding said wallpaper gradually into said joint, said body member having a portion thereof in the shape of a portion of the lateral surface of the cone, an apex end and a base end;

b. a first substantially flat flange attached along one edge thereof to said body member such that the plane of said flange is substantially tangent to said conically-shaped portion of said body member, said flange extending outwardly therefrom for positioning said trimming device against said wall being papered and pressing said wallpaper against said wall;

c. a second substantially flat flange attached along one edge thereof to said body member such that the plane of said flange is substantially tangent to said conically-shaped portion of said body member, said flange extending outwardly therefrom for positioning said trimming device against said wall being papered and pressing said wallpaper against said wall, the respective planes of said first and said second flanges converging upon one another toward an imaginary line located beyond said edges of attachment of said flanges to said body member in directions opposite the directions of outward extension of said flanges from said body member;

d. a handle attached to said body member for manipulating said trimming device; and e. a cutting member attached to said body member at said apex end for cutting said wallpaper at said joint, said cutting member being positioned by said body member and one of said flanges selected to position said trimming device against said wall being papered.

2. The trimming device of claim 1 wherein said handle is elongate in shape, and projects away from said body member in a direction away from the line of convergence of said flange planes and away from said apex end.

3. The trimming device of claim 1 wherein said cutting member includes a cutting edge having a cutting direction and further including means for adjusting said cutting direction with respect to said flanges.

4. The trimming device of claim 3 wherein said cutting member comprises an elongate blade with a cutting edge and said adjusting means comprises a cylindrical blade holder for holding said blade, a cylindrical receptacle attached to said body member for receiving said blade holder and permitting rotation thereof and means for fastening said blade holder in a fixed position in said receptacle.

5. The trimming device of claim 1 wherein said cutting member is attached to said handle and said device includes means for releasing said handle from said body member along with said cutting member.

6. The trimming device of claim 1 wherein said cutting member comprises an elongate blade, further including blade holder means connected to said body member for attaching said blade thereto, said blade holder means including means for adjusting the distance of protrusion of said blade outwardly from said body member.

7. The trimming device of claim 1 further comprising a pair of finger rest means disposed adjacent said apex end of said device on opposite sides of said body member.

8. A wallpaper trimming device for cutting wallpaper at a joint between a wall being papered and an adjacent structural member, said trimming device comprising:

a. a body member for positioning said trimming device against said adjacent structural member and guiding said wallpaper gradually into said joint, said body member having a portion of its outer surface in the shape of a portion of the lateral surface of a cone, an apex end and a base end;

b. a substantially flat flange attached along one edge thereof to said body member such that the plane of said flange is substantially tangent to said conically-shaped portion of said body member, said flange extending outwardly therefrom, for positioning said trimming device against said wall being papered and pressing said wallpaper against said wall;

c. an elongate handle member having cutting means disposed at a front end thereof; and d. means for releasably attaching said handle member to said body member such that said cutting means is disposed at said apex end of said trimming device for cutting said wallpaper at said joint, said cutting member being positioned by said body member, said handle and said flange.

9. A wallpaper trimming device for cutting wallpaper at a joint between a wall being papered and an adjacent structural member, said trimming device comprisig:

a. a body member for positioning said trimming device against said adjacent structural member and guiding said wallpaper gradually into said joint, said body member having a portion of its outer surface in the shape of a portion of the lateral surface of a cone, an apex end and a base end;

b. a substantially flat flange attached along one edge thereof to said body member such that the plane of said flange is substantially tangent to said conically shaped portion of said body member, said flange extending outwardly therefrom for positioning said trimming device against said wall being papered and pressing said wallpaper against said wall;

c. a handle attached to said base end of said body member for manipulating said trimming device;

d. a cutting member, including a cutting edge having a cutting direction, attached to said body member at said apex end for cutting said wallpaper at said joint, said cutting member being positioned by said body member and said flange; and e. means for adjusting said cutting direction of said cutting edge with respect to said flange.

* * * * *